US005881593A

United States Patent [19]

Bulso, Jr. et al.

[11] Patent Number: 5,881,593

[45] Date of Patent: Mar. 16, 1999

[54] METHOD AND APPARATUS FOR FORMING A BOTTOM-PROFILED CUP

[75] Inventors: Joseph D. Bulso, Jr.; Terry L. Gang, Jr., both of Canton; Gregory A. Calderone, Massillon; Harry D. Stewart, North Canton; William J. Simmons, Canton, all of Ohio

[73] Assignee: Redicon Corporation, Canton, Ohio

[21] Appl. No.: 696,232

[22] Filed: Aug. 13, 1996

Related U.S. Application Data

[60] Provisional application No. 60/012,970, Mar. 7, 1996.

[51] Int. Cl. [6] ..... B21D 22/26

[52] U.S. Cl. ..... 72/336; 72/348

[58] Field of Search ..... 72/336, 347, 348, 72/349, 329, 351

[56] References Cited

U.S. PATENT DOCUMENTS

| | | | |
|---|---|---|---|
| 3,796,085 | 3/1974 | Fisher et al. | 72/348 |
| 3,844,154 | 10/1974 | Bozek | 72/336 |
| 3,998,174 | 12/1976 | Saunders | 72/348 |
| 4,587,825 | 5/1986 | Bulso, Jr. et al. | 72/329 |
| 5,024,077 | 6/1991 | Bulso, Jr. et al. | 72/348 |
| 5,394,727 | 3/1995 | Diekhoff et al. | 72/348 |

FOREIGN PATENT DOCUMENTS

| | | | |
|---|---|---|---|
| 1386335 | 4/1988 | U.S.S.R. | 72/329 |

*Primary Examiner*—Lowell A. Larson
*Attorney, Agent, or Firm*—Reese Taylor

[57] ABSTRACT

An apparatus and method for forming a cup (10) having a profiled bottom generally includes a draw die (20) disposed at a first level of a double acting press. The draw die (20) cooperates with a draw pad (22) and a cut edge (24) to form and hold a blank (28) formed from a sheet of material (M). A punch assembly (30) is configured to travel through the draw die (20), thereby drawing the blank (28) over the draw die (20) into a cup (60). The punch assembly (30) transports the cup (60) to a second level of the press where it bottoms out on a die core (50) and a ring pad (51). One element of the punch assembly (30) continues to move beyond the second level of the press, thereby drawing a portion of the cup (60) over the die core (50) and profiling the bottom of the cup (60). The profiled cup (10) is then returned to the second level of the press where it is removed from the punch assembly (30) and transferred. The bottom profile insures that the cup will retain its shape during the transfer operation.

11 Claims, 5 Drawing Sheets

METHOD AND APPARATUS FOR FORMING A BOTTOM-PROFILED CUP

CROSS-REFERENCES TO RELATED APPLICATIONS

This application claims the benefit of U.S. Provisional Application No. 60/012,970, filed Mar. 7, 1996.

FIELD OF THE INVENTION

This invention relates generally to the apparatus and method for forming drawn containers. More particularly, the invention relates to the apparatus and method for forming a drawn cup having a profiled bottom.

BACKGROUND OF THE INVENTION

One of the initial steps in forming cylindrical containers such as cans for carbonated beverages is forming a cup. A typical cup includes a circular base connected to a cylindrical sidewall. The cup is typically shorter and wider than a finished container. As such, the cups are typically subjected to a variety of additional processes that further form the cup into a finished container.

Container manufacturing lines operate at high speeds to produce large quantities of containers. Throughout these manufacturing lines, the container elements are transported from one work station to another work station where different forming processes are performed. One of the problems encountered in designing the manufacturing lines is that the container elements often become deformed when being transported from station to station. As the speed of the lines increases, the number of container elements that become deformed increases. This problem is aggravated by the constantly increasing economic pressures to reduce the gauge of the material used to form the containers. The deformations are caused by the collisions between the container elements and contact between the container elements and the machinery.

One deformation problem occurs after the initial step of forming a cup from a flat blank of material has occurred. The cups are generally intended to have circular bottoms with straight, cylindrical sidewalls. Later processes that further form these cups include tooling designed to operate on substantially cylindrical cups. After the cups are initially formed, however, various forces can cause the cups to warp. If a cup is sufficiently warped, the container eventually formed from it must be discarded as waste. Additionally, tooling damage and/or jamming can occur. It has therefore become desirable to form a cup that is more resistant to warping and deformation.

SUMMARY OF THE INVENTION

It, accordingly, becomes the principal object of this invention to provide a method and apparatus for forming a cup resistant to deformation that may safely be transported at higher rates of speed than conventional cups.

It is another object of the present invention to provide a method and apparatus for forming a cup having a profiled bottom that assists the cup in resisting various forces that cause the cup to warp or otherwise deform.

It is a further object of the present invention to provide a method and apparatus for forming a cup having a profiled bottom wherein the profiled bottom pulls an ordinarily warped bottom flat which in turn pulls the sidewalls of the cup straight to provide cylindricity to the cup.

It is still another object of the present invention to provide a method and apparatus for forming a cup having a profiled bottom where unformed material is inserted into a double action press at one level and a formed cup is ejected from a different level of the press.

In general, the apparatus utilized to form a cup having a profiled bottom according to the present invention includes an annular draw die, a punch assembly configured to travel through the draw die, a die core disposed in the path of the punch assembly, and a ring pad disposed about the die core and also in the path of the punch assembly.

The method of forming a cup having a profiled bottom according to the present invention includes the steps of blanking a section of material at a first level of a double action press, drawing the blank over a draw die with a punch assembly to form a cup, carrying the cup to a second level of the press with the punch assembly, drawing the cup on a die core with one element of the punch assembly to profile the bottom of the cup, returning the profiled cup to the second level of the press, and ejecting the profiled cup from the press.

These and other objects of the invention, as well as the advantages thereof over existing and prior art forms, which will be apparent in view of the following detailed description, are accomplished by means hereinafter described and claimed and illustrated in the accompanying drawings.

BRIEF DESCRIPTION OF THE PREFERRED EMBODIMENTS

Figure 1:
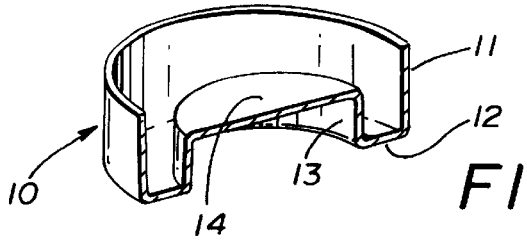
FIG. 1 is a sectional perspective view of a cup having a profiled bottom made by the apparatus and method of the present invention.

A cup having a profiled bottom formed by the apparatus and method of the present invention is depicted in FIG. 1 and is indicated generally by the numeral 10. The profiled cup 10 includes a generally cylindrical outer wall 11 that is connected at its bottom edge to the outer edge of an annular outer bottom wall 12. A generally cylindrical inner wall 13 extends upwardly from the inner edge of the outer bottom wall 12 in concentricity with outer wall 11 and connects with a generally circular inner bottom wall 14.

Figure 2:
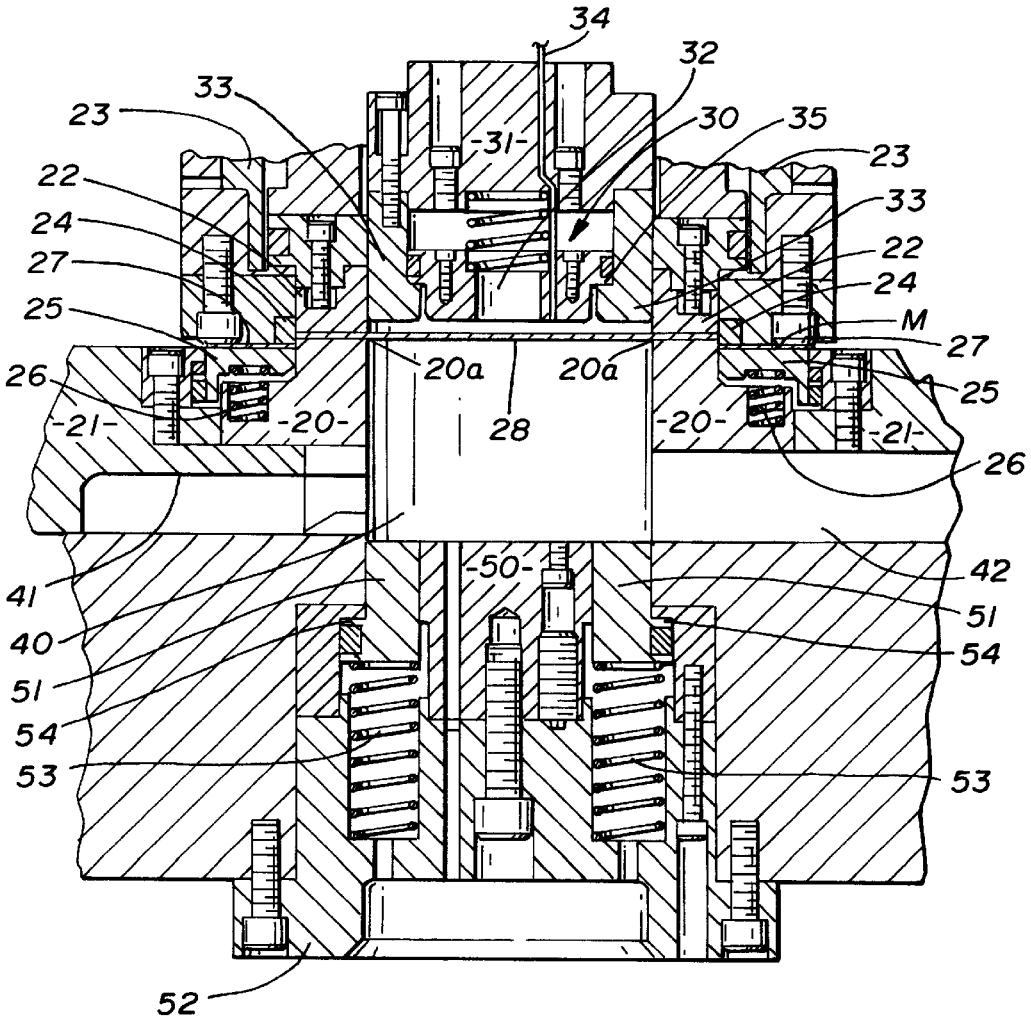
FIG. 2 is an elevational view, partially in section, showing the tooling of the present invention at the beginning of the blanking and drawing operation.
Figure 3:
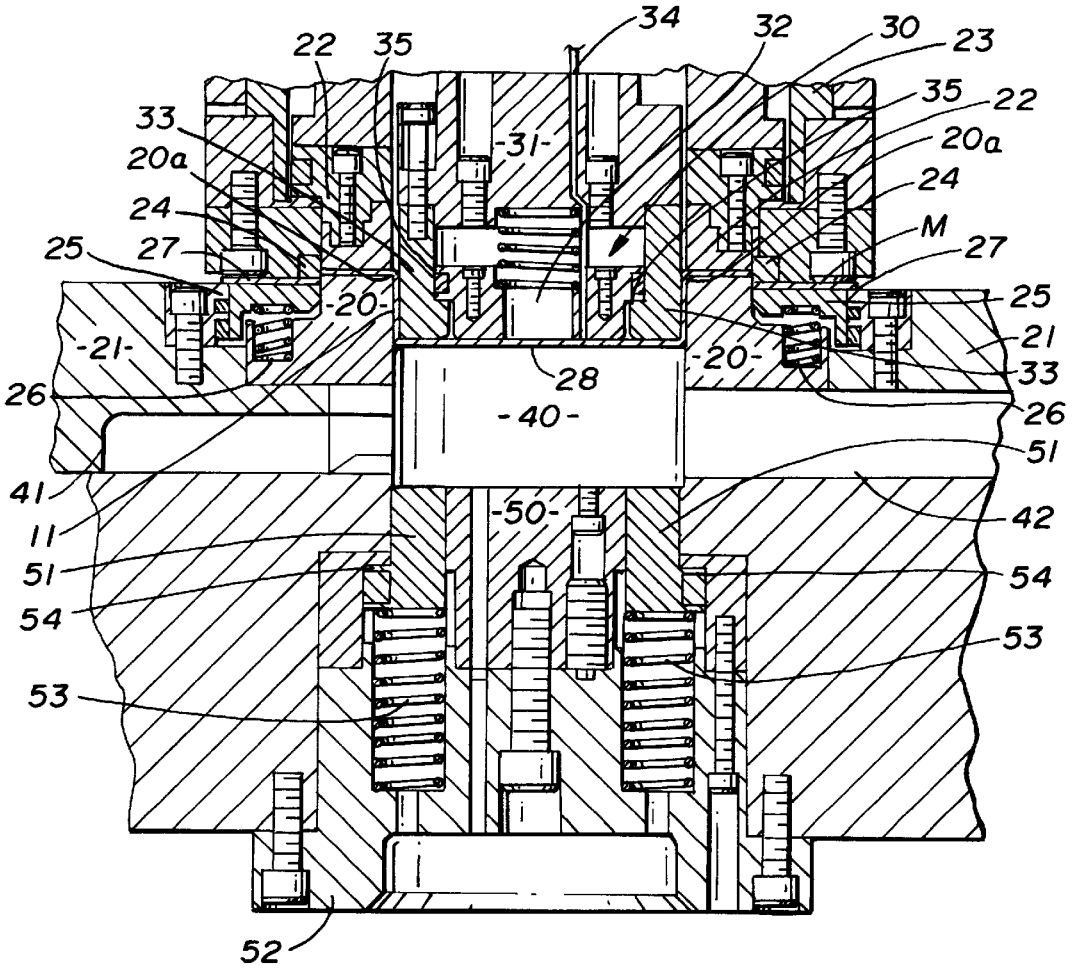
FIG. 3 is a view similar to FIG. 2, showing the position of the tooling during the first drawing operation.

Referring now to FIG. 2 of the drawings, it will be assumed that the tooling illustrated therein is incorporated into a double acting press of the type well known in this art. It will also be assumed that the material M will be fed into the press either from sheet or coil stock, as desired.

With these assumptions in mind, and still referring to FIG. 2, a sectional view of the tooling of the apparatus of the present invention may be seen. Thus, an annular draw die 20 is carried by the press wall 21. A draw pad 22 is disposed above the draw die 20 and is carried by the outer slide 23 of the double action press. The outer slide 23 is reciprocal to move the draw pad 22 upwardly away from draw die 20 and downwardly against draw die 20.

A cut edge 24 is disposed radially outward of the draw pad 22 on the outer slide and is operable to blank material M after the outer slide 23 lowers the draw pad 22 to clamp the material M against the draw die 20. A cut edge support pad 25 is supported by a spring 26 and is disposed beneath the cut edge 24. Thus, when the cut edge 24 has blanked material M, the scrap material 27 that is radially outward of the cut edge 24 is carried by the support pad 25 and the circular blank 28 that is radially inward of the cut edge 24 is held between the draw die 20 and the draw pad 22.

A punch assembly 30 is disposed radially inward of the draw pad 22 and is carried by an inner slide 31 of the press. The inner slide 31 is reciprocal to cause the punch assembly 30 to translate vertically through the draw die 20. The punch assembly 30 includes a centrally-disposed punch core 32 partially surrounded by an annular punch ring 33. The punch core 32 has a substantially flat bottom and a fluid passage 34 extending therethrough. The fluid passage 34 is selectively connected to a source of fluid pressure (not shown) such as pressurized air and is used for cup removal purposes as will be subsequently described.

When the punch assembly 30 is in the position depicted in FIGS. 2 through 4 and FIG. 6, the bottom surfaces of the punch core 32 and the punch ring 33 are substantially coplanar. The inner slide 31 is, however, operable to cause the punch ring 33 to move independently of punch core 32. For a purpose that will be subsequently described, the punch ring 33 may be moved downwardly, past the punch core 32 such that the bottom surface of the punch ring 33 is disposed below the bottom surface of the punch core 32. However, a pair of cooperating shoulders 35 formed in the punch core 32 and punch ring 33 prevent the bottom surface of the punch ring 33 from being raised above the bottom surface of the punch core 32.

In cooperation with the draw die 20, the press wall 21 forms a substantially cylindrical chamber 40 configured to receive the punch assembly 30 and the drawn cup 10. On one side of the chamber 40, a fluid line 41 extends through the press wall 21. The fluid line 41 is selectively connected to a source of pressurized fluid, such as air, for a purpose that will be subsequently described. Opposite the fluid line 41, the press wall 21 has an opening 42 that is configured to allow a drawn cup 10 to pass therethrough to exit the chamber 40.

The bottom of the chamber 40 is formed by the cooperation of an inner die core 50 and a ring pad 51 that encircles the inner die core 50. When the inner die core 50 and the ring pad 51 are in the position depicted in FIGS. 2 through 4 and FIG. 6, the upper surfaces of the inner die core 50 and the ring pad 51 are substantially coplanar. The inner die core 50 is carried by lower platen 52 and is stationary during the cup forming process. The ring pad 51 is, however, carried by a plurality of springs 53 that allow the ring pad 51 to be translated vertically with respect to the inner die core 50 under pressure from punch ring 33, as will be described. A pair of shoulders 54 formed in the lower platen 52 and the ring pad 51 cooperate to prevent the upper surface of the ring pad 51 from rising above the level of the upper surface of the inner die core 50.

Cups 10 having profiled bottoms are formed using the apparatus of the present invention in accordance with the following method. A sheet of material M is inserted at a first level of the press between the draw die 20 and the draw pad 22. Once the material M is correctly positioned, the outer slide 23 moves the draw pad 22 against the material M, thereby clamping the material M between the draw pad 22 and the draw die 20. Continued advance of outer slide 23 then causes the cut edge 24 to cut a substantially circular blank 28 out of the material M. The scrap material 27 is carried by the support 25 while the blank 28 remains clamped between the draw die 20 and the draw pad 22, as depicted in FIG. 2.

After the material M has been blanked, the inner slide 31 causes the punch assembly 30 to move against the blank 26 and through the draw die 20. This movement causes the blank 28 to be drawn over edge 20*a* of the draw die 20, and the outer wall 11 of the cup 10 begins to be formed as may be seen in FIG. 3. As the punch assembly 30 is moving through the draw die 20, the clamping pressure between the draw die 20 and the draw pad 22 is controlled by the outer slide 23.

Figure 4:
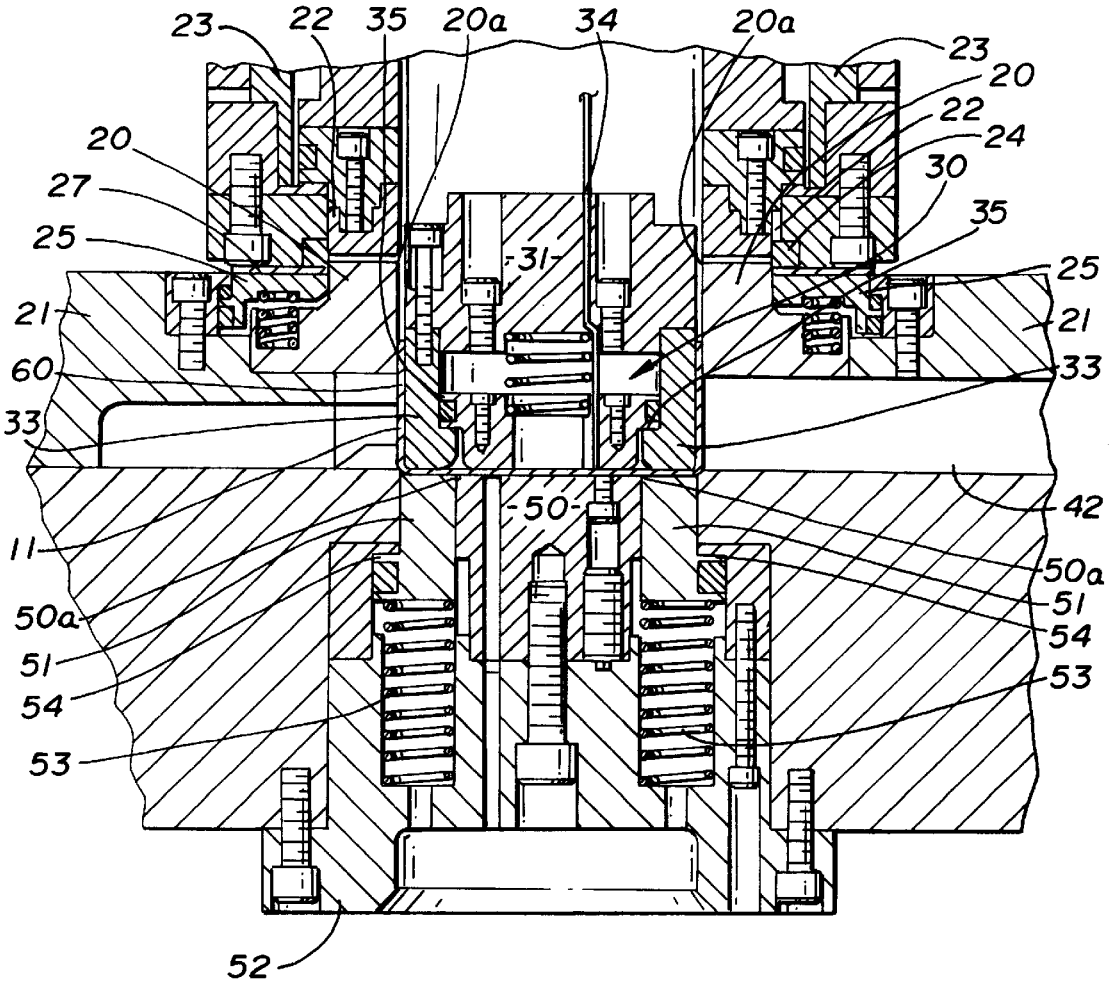
FIG. 4 is a view similar to FIG. 2, showing the position of the tooling after the first drawing operation.
Figure 5:
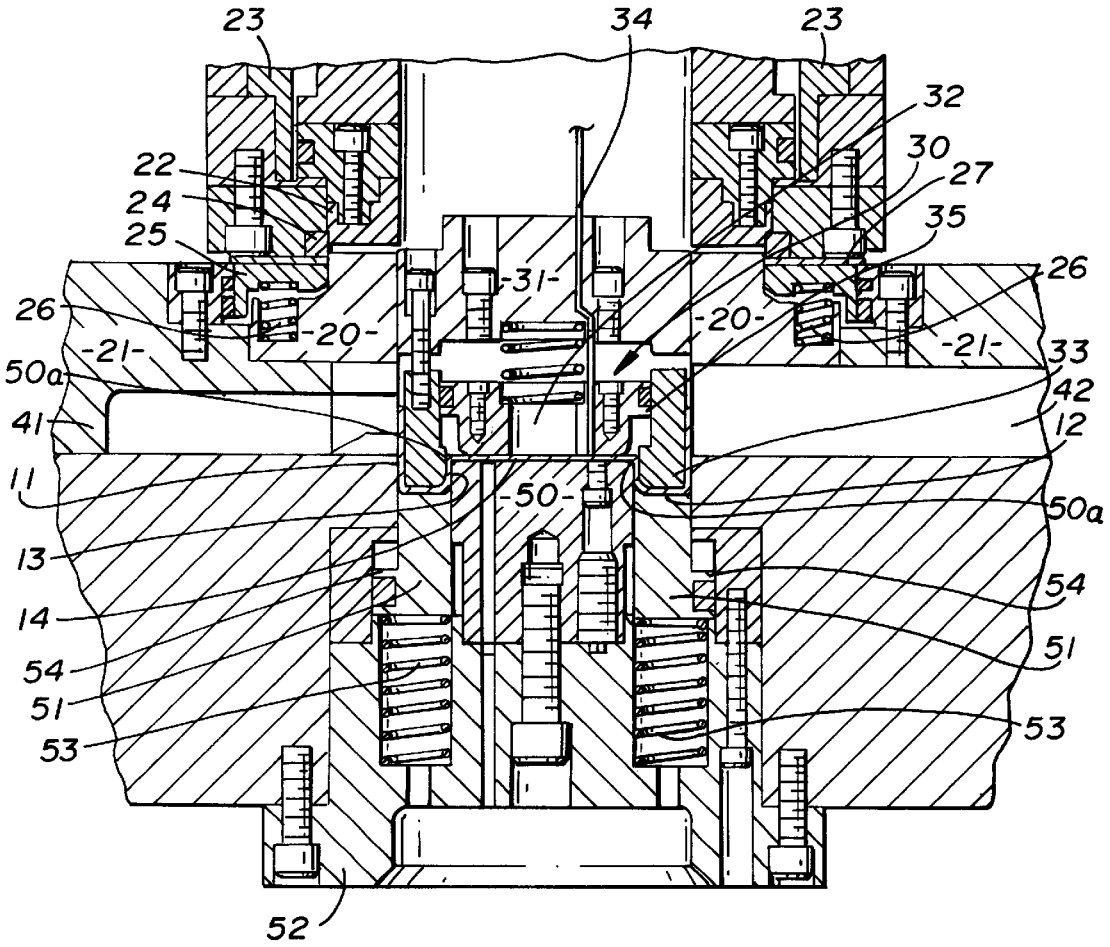
FIG. 5 is a view similar to FIG. 2, showing the position of the tooling after the second drawing operation.
Figure 6:
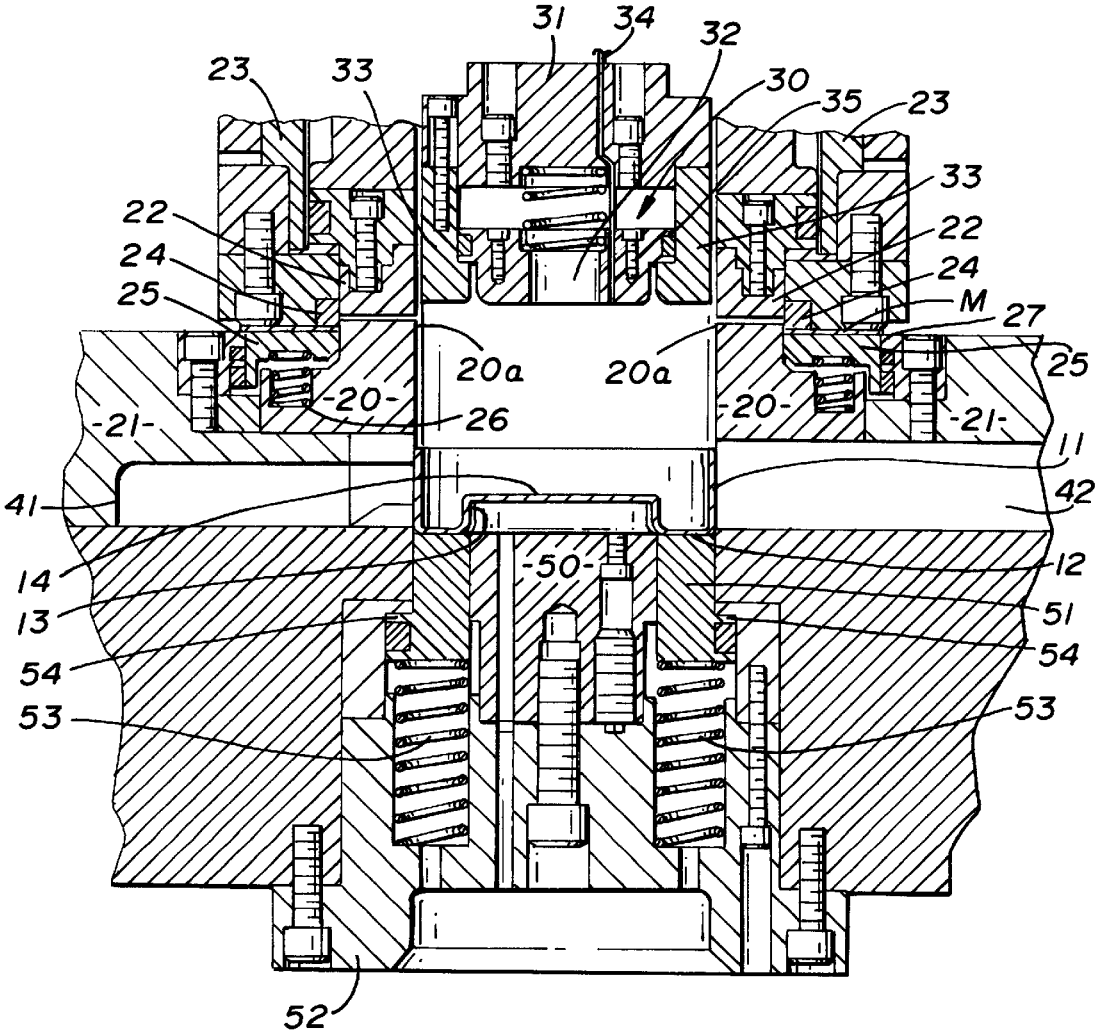
FIG. 6 is a view similar to FIG. 2, showing the position of the tooling after a cup having a profiled bottom has been formed according to the method of the present invention.

The punch assembly 30 continues to move through the draw die 20 until the entire blank 28 is drawn over the draw die 20, forming a cup 60. The inner slide 31 then continues to move the punch assembly 30 and the cup 60 downwardly to a second press level. The cup 60 remains on the punch assembly 30 as is shown in FIG. 4. When the punch core 32 bottoms out on the inner core die 50, the inner slide 31 causes the punch ring 33 to continue moving downwardly against the ring pad 51, overcoming the force of springs 53. This movement of the punch ring 33 causes bottom wall of the cup 60 to be drawn over the edge 50*a* of inner die core 50 to profile the bottom of the cup 60. As may be seen in FIG. 5, the extension of the punch ring 33 has formed the inner bottom wall 14 and outer bottom wall 12 of the profiled cup 10 as well as the generally cylindrical inner wall 13.

After the punch ring 33 has been fully extended, the inner slide 31 reverses its movement and the punch ring 33 is retracted. The springs 53 disposed beneath the ring pad 51 force the ring pad 51 upwardly against the punch ring 33 and force the cup 10 back to the second level of the press. The shoulders 54 and the shoulders 35 meet simultaneously and prevent the ring pad 51 from rising farther and cause punch ring 33 and the punch core 32 to begin rising together. As the punch assembly 30 is retracted, the cup 10 has the tendency to remain on the punch assembly 30. Activation of the fluid line 34 disposed in the punch core 32 provides a pneumatic force that helps to separate the cup 10 from the punch assembly 30, as may be seen in FIG. 6. The fluid line 41 in the press wall 21 is then activated to create a pneumatic force that pushes the cup 10 out of the opening 42 in the press wall 21, following which it may be transferred to other apparatus for further operations.

While a full and complete description of the invention has been set forth in accordance with the dictates of the patent statutes, it should be understood that modification can be resorted to without departing from the spirit hereof or the scope of the appended claims.

What is claimed is:

1. An apparatus for forming a bottom-profiled cup from a sheet of material in a double acting press having a fixed lower platen and a movable upper platen, the apparatus comprising:

a) a draw die carried by the lower platen and having an upper surface defining a first level for receiving material to be blanked;

b) a punch assembly carried by the upper platen;

c) said punch assembly selectively movable beyond said first level and having a punch core and an annular punch ring, said annular punch ring being disposed concentrically outboard of said punch core and being selectively movable with respect to said punch core;

d) a cut edge disposed at said first level;

e) a draw pad disposed concentrically outboard of said annular punch ring;

f) an inner die core carried by the lower platen and having an upper surface defining a second level for removal of the profiled cup; and g) a ring pad circumscribing said inner die core and being independently movable with respect to said inner die core;

h) said punch assembly being movable through said draw die toward said inner die core and said ring pad from a position above said first level to said second level and said punch ring being movable relatively of said punch core to a position below said second level; and i) said ring pad being movable toward said upper platen to raise the cup to said second level.

2. The apparatus according to claim 1, further comprising at least one spring biasing said ring pad toward said annular punch ring; said at least one spring being carried by said lower platen.

3. The apparatus according to claim 1, wherein said inner die core and said ring pad have upper surfaces; said ring pad and said lower platen having a pair of cooperating shoulders; and said pair of cooperating shoulders preventing said upper surface of said ring pad from being raised above said upper surface of said die core.

4. The apparatus according to claim 1, wherein said annular punch ring and said punch core have bottom surfaces; said annular punch ring and said punch core have a pair of cooperating shoulders; and said pair of cooperating shoulders preventing said bottom surface of said annular punch ring from being raised above said bottom surface of said punch core.

5. The apparatus according to claim 1, wherein said punch core has a fluid passage therethrough; said fluid passage being in selective fluid communication with a source of pressurized air.

6. The apparatus according to claim 1, further comprising a draw pad disposed adjacent to said draw die and being selectively movable toward and away from said draw die independently of said punch assembly.

7. A method of forming a bottom-profiled cup from a sheet of material in a press comprising the steps of:

a) blanking a generally circular blank from the sheet of material at a first level of the press;

b) forming a cup having an outer sidewall and a bottom wall by drawing the blank over a draw die with a punch assembly having a punch core and an annular punch ring by advancing the punch core, punch ring, and cup assembly past said first level of the press to a second level;

c) profiling the bottom wall of the cup by drawing the bottom wall of the cup over a die core by advancing said punch assembly and the cup past said second level;

d) returning the profiled cup to said second level and withdrawing said punch; and e) removing the profiled cup from said second level.

8. The method according to claim 7, wherein the step of blanking a generally circular blank comprises the steps of:

a) inserting the sheet of material at said first level of the press;

b) clamping the sheet of material between a draw pad and a draw die;

and c) advancing a cut edge through the sheet of material to cut a substantially circular blank from the section of raw material.

9. The method according to claim 7, wherein said step of profiling the bottom wall of the cup comprises the steps of bottoming out the punch core on the die core and continuing to advance the punch ring past the punch core below said second level of the press to draw the bottom wall of the cup over the die core.

10. The method according to claim 9, wherein the punch ring displaces a ring pad against at least one spring when the punch ring is advanced past the punch core.

11. The method according to claim 10, wherein the method of forming a bottom-profiled cup further comprises the step of returning the cup to said second level of the press.

* * * * *